United States Patent [19]

MacDonnell

[11] 4,092,932

[45] June 6, 1978

[54] REPLACEABLE BOLSTER GIB ARRANGEMENT

[75] Inventor: Robert W. MacDonnell, Crete, Ill.

[73] Assignee: R. W. Mac Company, Crete, Ill.

[21] Appl. No.: 708,900

[22] Filed: Jul. 26, 1976

[51] Int. Cl.[2] ..... B61F 5/04; B61F 5/50; F16C 17/00; F16C 25/02

[52] U.S. Cl. ..... 105/207; 105/225

[58] Field of Search ..... 105/207, 225

[56] References Cited

U.S. PATENT DOCUMENTS

| | | | |
|---|---|---|---|
| 703,503 | 7/1902 | Tunks | 105/207 |
| 761,650 | 6/1904 | Bemis | 105/207 X |
| 2,482,219 | 9/1949 | Shaffer | 105/207 |

FOREIGN PATENT DOCUMENTS

| | | | |
|---|---|---|---|
| 28,387 of | 1910 | United Kingdom | 105/207 |

*Primary Examiner*—Drayton E. Hoffman
*Assistant Examiner*—Howard Beltran
*Attorney, Agent, or Firm*—J. Patrick Cagney

[57] ABSTRACT

A replaceable bolster gib comprises a U-shaped holder block fixed to the bolster, a trough-shaped wear shoe block having a pocket complementary to the holder block and mounted in embracing force transmitting relation thereon, and an interlocking means such as a spring steel cotter pin drive in force fit relation through the holder and overlapping portions of the wear shoe to removably retain the blocks.

11 Claims, 5 Drawing Figures

FIG. 1
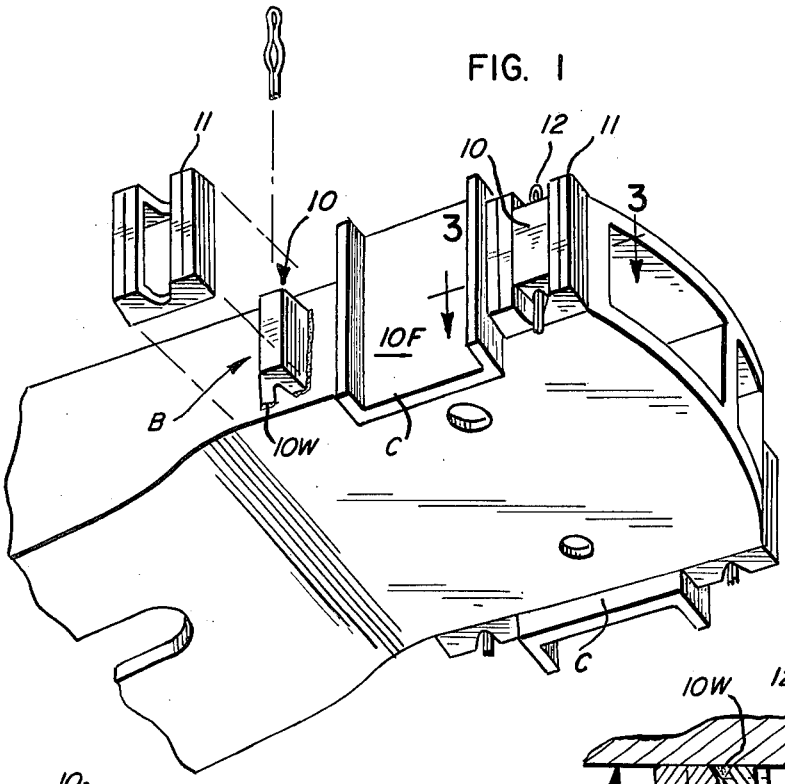
FIG 3
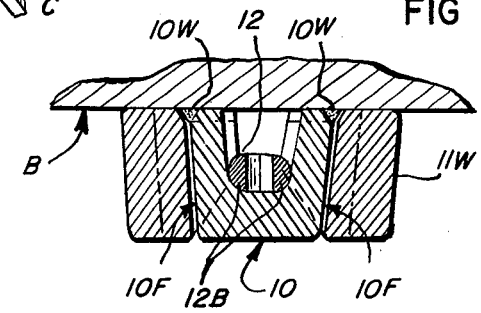
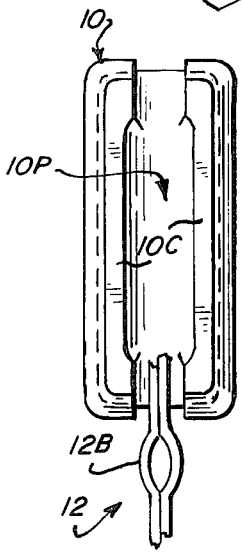
FIG. 4
FIG. 2
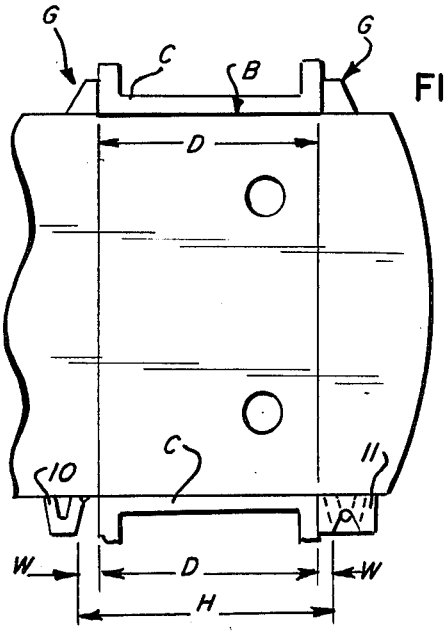
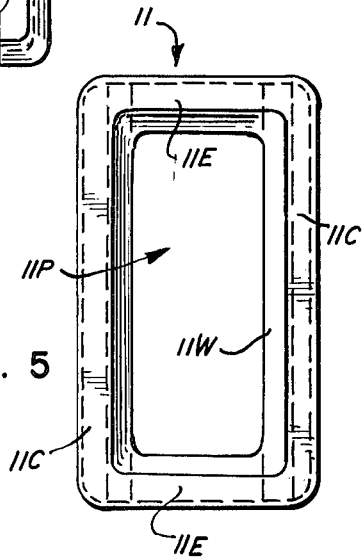
FIG. 5

REPLACEABLE BOLSTER GIB ARRANGEMENT

BACKGROUND OF THE INVENTION

This invention relates to bolsters for freight car trucks and more particularly is concerned with providing a replaceable gib arrangement for either new or used bolsters.

At present, it is conventional to provide that after predetermined wear, the gibs must be restored. Currently, the worn gib is built-up by depositing weld metal until sufficient build-up of metal is achieved.

This weld build-up procedure is not only difficult and time-consuming, but it requires complete dismantling of the truck whenever gib repair is required and it limits the choice of the gib wear surface material so that undesired side frame wear can also result in the case of conventional freight car truck designs.

There is a need for improved bolster gib arrangements to reduce the over-all truck wear problem and to simplify replacement of worn gibs.

SUMMARY OF THE INVENTION

The present invention provides a replaceable gib construction adaptable to both integrally cast new bolsters and to retro-fit application on used bolsters.

More particularly, the invention relates to a railway truck bolster having sidewall structure at each end for controlled movement between confronting truck side columns and it provides an improved bolster guide arrangement comprising holder means fixed to and projecting from the bolster sidewall structure in flanking spaced relation to the corresponding sidewall structure, wear shoe means seated on the holder means in force transmitting relation to cooperate with the side column structure in limiting relative horizontal movement between the bolster and side column structures, and interlocking means captively engaged between the holder means and wear shoe means for removably retaining the wear shoe means on the holder means.

In the preferred embodiment, the holder means is a vertically elongated U-shaped block defining a vertical passage; the wear shoe means is a generally rectangular trough-shaped block embracing the U-shaped block and having vertical sidewall means interconnecting upper and lower end wall means to define a central pocket complementary to the U-shaped block; and the interlocking means is a spring steel cotter pin projecting through the passage in the U-block and overlapping the end walls of the trough-block to hold the blocks in direct force transmitting relation.

The pin has bowed leg portions defining a bulge that is driven through the holder for force fit engagement therewith.

The holder block is undercut along the outer periphery of its bolster contact face to provide clearance for sufficient weld to firmly secure the holder on the bolster.

The wear shoe block is undercut along the inner periphery of its bolster contact fact to provide clearance for any weld spill.

The parts are symmetrical to accommodate universal mounting and reversability of the wear shoe when its first sidewall is worn.

Other features and advantages of the invention will be apparent from the following description and claims, and are illustrated in the accompanying drawings which show structure embodying preferred features of the present invention and the principles thereof, and what is now considered to be the best mode in which to apply these principles.

BRIEF DESCRIPTION OF THE DRAWINGS

In the accompanying drawings forming a part of the specification, and in which like numerals are employed to designate like parts throughout the same;

FIG. 1 is a perspective view illustrating a conventional truck bolster, equipped with gib holders and gib shoes in accordance with this invention;

FIG. 2 is a diagrammatic view of a bolster end illustrating comparative mounting locations for conventional gibs and for the gib arrangement of this invention;

FIG. 3 is a transverse section taken on the line 3 — 3 of FIG. 1;

FIG. 4 is a rear elevation of the gib holder;

FIG. 5 is a rear elevation of the gib wear shoe.

DESCRIPTION OF THE PREFERRED EMBODIMENT

Referring now to the drawings, the invention is shown in FIG. 1, as a retro-fit application to a used bolster, wherein the sidewall structure of the bolster end region provided with welded-on outboard and inboard gib holders 10, with each holder 10 receiving a wear shoe 11 in force transmitting relation to cooperate with the confronting truck side column structures C in limiting relative horizontal movement therebetween. Interlocking means 12 shown as a spring steel key or cotter pin 12 removably retains each wear shoe 11 on its holder 10. For purposes of comparison, a standard bolster gib configuration is shown at the top of FIG. 2 and the holders of this invention are shown at the bottom of FIG. 2 to illustrate the difference between the locations of the gib holders 10 of this invention and the locations of the conventional integral gibs G on standard bolsters. Thus, where the wear faces of conventional gibs are spaced a distance D, the confronting faces of the present gib holders are spaced a distance $H = D + 2W$ where $W$ is the total thickness of the wear face wall 11 W of each wear shoe 11.

For simplicity of application, all gib holders 10 are identical and all wear shoes 11 are identical and each may be installed with either end up. Both the holders and the shoes are of the same thickness and project the same distance from the bolster sidewalls as the standard gib. The holder is sized to meet and exceed the strength requirements of used standard gibs, that is, gibs which are at least 60% of original size. The holder strength is not affected by wear in the case of the present arrangement so that it will always exceed the 60% gib strength requirements of the A.A.R.

In the preferred embodiment, each gib holder 10 is an elongated U-shaped block as shown in transverse section in FIG. 3, with its sidewalls or legs 10 W presenting vertically extending lateral faces 10 F inclined towards each other to define a slight external horizontal taper. The holder block thus defines a vertical passage 10 P (FIG. 4) opening through both ends of the holder and having an enlarged central region. The outer periphery of the bolster contact faces 10 C (FIG. 4) of the holder are undercut or beveled to facilitate a secure weld connection.

Preferably, each wear shoe 11 is a hollow, generally trough-shaped rectangular block that embraces the holder in force transmitting interengaged relation. Each wear shoe block 11 presents a pair of vertical sidewalls 11 W interconnecting upper and lower end walls 11 E to define a central pocket 11 P that is complementary to the holder block. The wear shoe sidewalls are of the same depth as the holder block and are of the same size and shape to permit reversability of the wear shoes after one side is worn. Indicator lines 11 L are shown integrally cast on the outer face of each sidewall 11 W to facilitate inspection of the amount of wear.

The end walls 11 E of the wear shoes have outwardly facing abutment surfaces bordering and defining V-shaped notches located in outwardly offset relation to be eccentrically located. The apex of each notch overlaps with the vertical passage in the holder to define therewith a composite central socket for the interlock key 12. The inner periphery of the bolster contact faces 11 C of the wear shoe is undercut for insuring clearance for any weld spill along the holder weld lines W (FIG. 3).

The interlock key 12 is driven into locked position in the composite central socket. The key 12 has bowed leg portions 12 B that establish a bulge for force fit engagement with the holder to retain the key in place. The key may have intermediate bowed leg portions to engage in the enlarged central region of the holder as shown in FIG. 3 or may have bowed end portions to engage beneath the lower end of the holder as shown in FIG. 4.

The interlock thus has a snug fit and engages in overlapping relation with the V-shaped abutment surfaces of the end walls of the wear shoe.

Where castings are employed, the holders and shoes may be M-210-75, Grade B or carbon steel. In the case of forgings, the holders may be M-126, Grade A normalized and the shoes may be M-126, Grade C normalized and heat-treated to a hardness of Rockwell C-20 (max.). The holder materials are selected for weldability and the shoe materials are selected for wear properties. In particular, it is advantageous that the wear shoe be softer than the truckside, which typically is of Rockwell C-40, to promote preferential wear of the easily replaceable shoe.

In a typical application procedure, the bolster is removed from the truckside, the worn out guides are removed by saw cutting or a cutting torch and the bolster contact surfaces may be smoothed by grinding and cleaning.

The holders are tack welded in pre-determined positions using a suitable gage or fixture. The bolster contact areas are pre-heated to about 150° F and the holder block is welded to the bolster along its entire outer periphery, with double pass weld along both sides. It is preferred to use low hydrogen type E 8018-C3 or equivalent electrode, ¼ inch plus.

The wear shoes and interlock pins are applied to the inner holders prior to assembly of the trucks and to the outer holders after assembly to the trucks.

Advantages of the disclosed arrangement include:

1. No future rebuilding of gibs by welding or truck dismantling required on account of worn out gibs.

2. Two wear surfaces on each shoe affords double the amount of service life before having to be replaced.

3. Wear limit indicator line is cast into shoes to eliminate the guesswork on when to change over or renew shoes.

4. Double wear shoes can be easily changed by driving out the spring steel locking pin or key from the holder, turning the shoe around, or, if both sides are worn out, replace with new shoe and drive spring locking pin or key into position.

5. Wear shoes can be changed or replaced on any repair track without dismantling the truck.

6. Affords better bolster truck lateral control, and, less total truck wear due to truck hunting, etc.

7. Special hardness of wear shoe surfaces allows for maximum wear to occur to the wear shoes, thereby reducing the amount of wear that now takes place on the truckside columns. This action will, in turn, mean that the truck service life will be greatly extended.

It should be noted that the invention is also applicable for new bolsters. In new bolsters, the holders may be integral case as part of a one-piece bolster or may be welded to the bolster sidewall structure in any suitable fasion. For example, a new bolster may be provided with integral locator pads projecting centrally from the holder mounting region of the bolster sidewall and the holder may be telescoped over the locator pad and welded directly to the bolster sidewall.

The wear shoe may be of multi-piece construction in that it may have cast sidewalls arranged to receive snap on wear faces of lubric, plastic material to reduce wear between the gib and side column and to further simplify replacement of the wear shoe face.

Thus, while preferred constructional features of the invention are embodied in the structure illustrated herein, it is to be understood that changes and variations may be made by those skilled in the art without department from the spirit and scope of the appended claims.

What is claimed is:

1. In a railway truck bolster structure having side wall structure adjacent each end region for controlled movement between confronting truck side column structures, an improved bolster guide arrangement comprising holder means fixed to and projecting from the bolster side wall structure in flanking spaced relation to the corresponding side column structure, wear shoe means seated on the holder means in force transmitting relation to cooperate with the side column structure in limiting relative horizontal movement between the bolster and side column structures, and interlocking means captively engaged between the holder means and wear shoe means for removably retaining the wear shoe means on the holder means wherein said holder means is a vertically elongated generally U-shaped block defining a vertical passage, said wear shoe means is a generally rectangular trough-shaped hollow block embracing the U-shaped block and having vertical side wall means interconnecting upper and lower end wall portions to define a central pocket complementary to the U-shaped block, and said interlocking means projects through the passage of the U-shaped block and overlaps end wall portions of the trough-shaped block to hold the blocks in direct force transmitting relation.

2. In a railway truck bolster structure as defined in claim 1 wherein said holder means and said wear shoe means project substantially the same distance from the bolster side wall structure.

3. In a railway truck bolster structure as defined in claim 1 wherein said wear shoe means embraces the holder means and said interlocking means projects through said holder means and overlaps portions of said wear shoe means to hold the wear shoe means against portions of the bolster side wall structure that border the holder.

4. In a railway truck bolster as defined in claim 3 wherein said holder means and said wear shoe means are substantially the same distance from the bolster side wall structure.

5. In a railway truck bolster as defined in claim 1 wherein said vertical side wall means of the trough-shaped block and said U-shaped block project substantially the same distance from the bolster side wall structure.

6. In a railway truck bolster as defined in claim 1 wherein said interlocking means comprises a spring steel cotter pin having bowed leg portions defining a resilient bulge in force fit engagement with the holder block.

7. A bolster gib arrangement comprising holder means having a vertical passage, wear shoe means embracing the holder means in force transmitting interengaged relation and interlocking means captively engaged between the holder means and wear shoe means for removably retaining the wear shoe means on the holder means wherein said holder means is a vertically elongated generally U-shaped block defining a vertical passage, said wear shoe means is a generally rectangular trough-shaped hollow block embracing the U-shaped block and having vertical side wall means interconnecting upper and lower end wall portions to define a central pocket complementary to the U-shaped block, and said interlocking means projects through the passage of the U-shaped block and overlaps end wall portions of the trough-shape block to hold the blocks in direct force transmitting relation.

8. A bolster gib arrangement as defined in claim 7 wherein said interlocking means projects through said passage and overlaps portions of said wear shoe means to retain the wear shoe means and holder means in direct interengaged relation.

9. A bolster gib arrangement as defined in claim 7 wherein said vertical side wall means of the trough-shaped block and said U-shaped block are of substantially the same depth.

10. A bolster gib arrangement as defined in claim 7 wherein said interlocking means comprises a spring steel cotter pin having bowed leg portions defining a resilient bulge in force fit engagement with the holder block.

11. A removable bolster gib shoe comprising a generally rectangular, trough-shaped hollow block having vertical side wall means interconnecting upper and lower end wall portions to define a central pocket, each end wall portion having an abutment surface bordering a frontal notch aligned with the pocket, and said side wall means having lateral soft wear surfaces.

* * * * *